US011898301B2

(12) United States Patent
Reeves et al.

(10) Patent No.: US 11,898,301 B2
(45) Date of Patent: Feb. 13, 2024

(54) DRYER APPLIANCE AND VARIABLE ADDITIVE DISPENSING

(71) Applicant: Haier US Appliance Solutions, Inc., Wilmington, DE (US)

(72) Inventors: Joshua Reeves, Louisville, KY (US); Sean Simpson, Charlottesville, VA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/694,997

(22) Filed: Mar. 15, 2022

(65) Prior Publication Data

US 2023/0295864 A1 Sep. 21, 2023

(51) Int. Cl.
*D06F 58/44* (2020.01)
*D06F 58/20* (2006.01)

(52) U.S. Cl.
CPC ..... *D06F 58/44* (2020.02); *D06F 58/203* (2013.01)

(58) Field of Classification Search
CPC ..... D06F 58/44; D06F 58/203
See application file for complete search history.

(56) References Cited

U.S. PATENT DOCUMENTS 5,411,164 A 5/1995 Smith et al.
5,787,606 A 8/1998 Bokholdt
6,922,913 B2 8/2005 Hood et al.
7,066,412 B2 6/2006 Conley et al.
D622,989 S 9/2010 Lagler et al.
8,914,989 B2 12/2014 Ghosh et al.
9,702,077 B2 7/2017 Doh
2003/0224962 A1 12/2003 Fryc
2005/0076534 A1* 4/2005 Ofosu-Asante ..... D06F 34/18 34/597
2010/0327004 A1 12/2010 Post
2012/0085673 A1 4/2012 White
2013/0000141 A1* 1/2013 Ghosh ..... D06F 58/36 34/524
2021/0115618 A1 4/2021 Lee et al.

FOREIGN PATENT DOCUMENTS

RU 2578112 C2 3/2016

* cited by examiner

*Primary Examiner* — Jessica Yuen
(74) *Attorney, Agent, or Firm* — Dority & Manning, P.A.

(57) ABSTRACT

A dryer appliance may include a cabinet, a drum, an additive dispensing assembly, and a controller. The drum may be rotatably mounted within the cabinet. The drum may define a drying chamber for the receipt of clothes for drying. The additive dispensing assembly may be positioned within the cabinet and configured to selectively provide an additive to the drying chamber. The controller may be in operable communication with the additive dispensing assembly. The controller may be configured to initiate a drying operation. The drying operation may include initiating a dry cycle, detecting a static event during the dry cycle, and directing a supplemental dispensing action of a dryer additive in response to the detected static event.

18 Claims, 6 Drawing Sheets

DRYER APPLIANCE AND VARIABLE ADDITIVE DISPENSING

FIELD OF THE INVENTION

The present subject matter relates generally to dryer appliances, and more particularly to and more particularly to system or methods for selectively dispensing an additive therein.

BACKGROUND OF THE INVENTION

Dryer appliances generally include a cabinet with a drum mounted therein. In some dryer appliances, a motor rotates the drum during operation of the dryer appliance (e.g., to tumble articles located within a chamber defined by the drum). Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance.

In some instances, it may be desirable to provide certain objects or fluids for the treatment of articles within a dryer appliance. For instance, dryer sheets are commonly placed within the drum of a dryer appliance to affect the smell of the fabrics or clothes being treated (i.e., tumbled or dried) in a specific laundry load. In other instances, a wrinkle release fluid (e.g., fluids comprising fabric relaxer, fabric softener, isopropyl alcohol, vinegar, etc.) may be applied to sprayed on articles by a user before or after the articles are treated by the dryer appliance. In still other instances a UV fabric protector (e.g., fluids comprising titanium oxide, bemotrizinol, etc.) to absorb or repel ultraviolet light emissions may be sprayed on articles by a user before or after the articles are treated by the dryer appliance. However, difficulties exist with such approaches. Specifically, a user must generally remember to supply a specific object or fluid to each individual drying load. In many cases, additives are simply added once prior to starting a drying operation, instead of when such additives may be most effective. Moreover, in many cases a user must estimate or guess how much of the specific object or fluid is appropriate for an individual load. Although some existing dryer appliances provide for automatically (e.g., without direct user input) supplying steam to individual dryer loads, existing dryer appliances are generally unable vary the timing or volume of such dispensing.

Accordingly, a dryer appliance capable of delivering one or more additives affecting the smell or performance of fabrics would be desirable. Additionally or alternatively, it may be useful to provide a dryer appliance or method for dispensing one or more additives at a variable amount or time (e.g., after significant drying has first occurred).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet, a drum, an additive dispensing assembly, and a controller. The drum may be rotatably mounted within the cabinet. The drum may define a drying chamber for the receipt of clothes for drying. The additive dispensing assembly may be positioned within the cabinet and configured to selectively provide an additive to the drying chamber. The controller may be in operable communication with the additive dispensing assembly. The controller may be configured to initiate a drying operation. The drying operation may include initiating a dry cycle, detecting a static event during the dry cycle, and directing a supplemental dispensing action of a dryer additive in response to the detected static event.

In another exemplary aspect of the present disclosure, a method of operating a dryer appliance is provided. The method may include initiating a dry cycle and detecting a static event during the dry cycle. The method may further include directing a supplemental dispensing action of a dryer additive in response to the detected static event.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
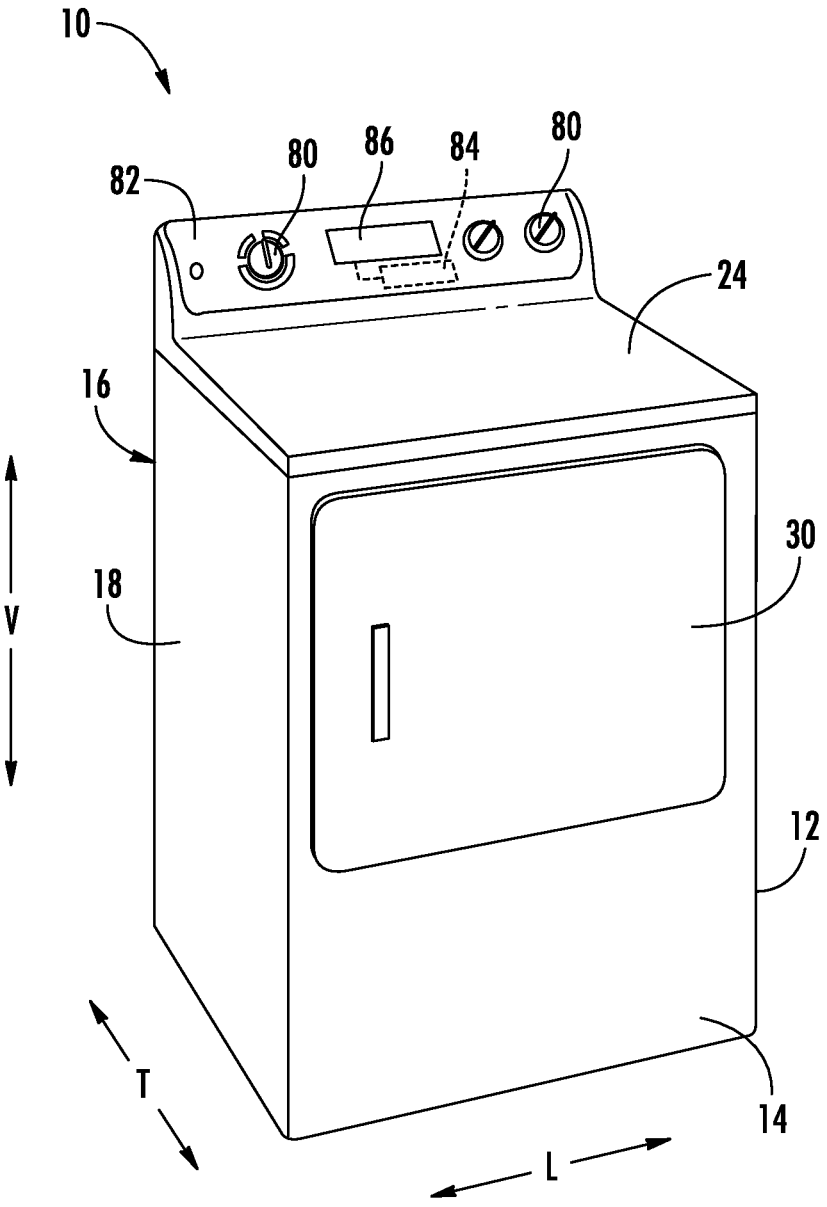
FIG. 1 provides a perspective view of a dryer appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
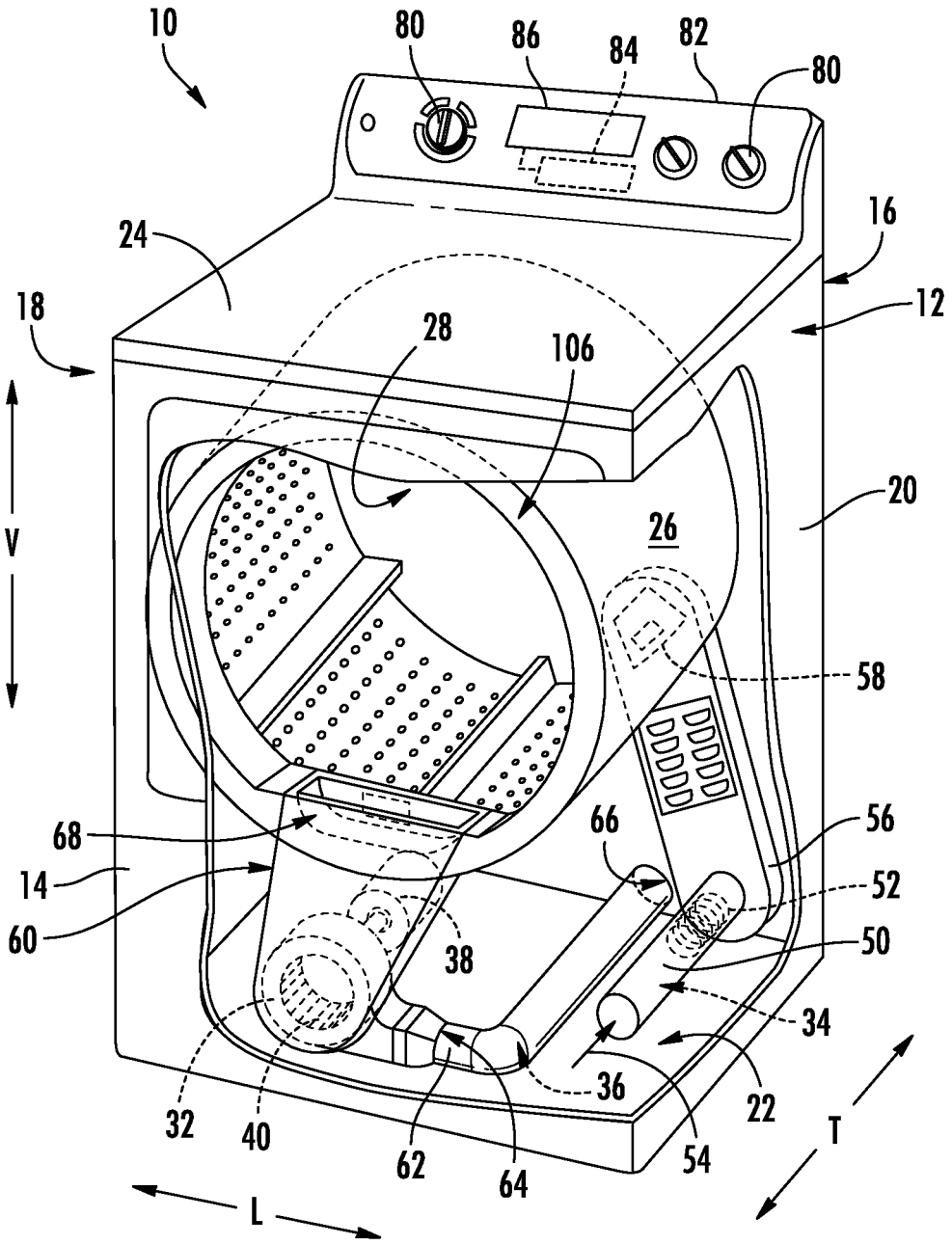
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Within cabinet 12 is a container or drum 26 which defines a chamber 28 for receipt of articles (e.g., clothing, linen, etc.), for drying. Drum 26 extends between a front portion and a back portion (e.g., along the transverse direction T). In example embodiments, drum 26 is rotatable (e.g., about an axis that is parallel to the transverse direction T) within cabinet 12. A door 30 is rotatably mounted to cabinet 12 for providing selective access to drum 26.

An air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26 (e.g., in order to dry articles located therein) as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly 50 (e.g., in order to dry damp articles disposed within chamber 28 of drum 26). Heating assembly 50 includes a heater 52 that is in thermal communication with chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of inlet duct 56 positioned at a rear wall of drum 26.

Within chamber 28, the heated air can remove moisture (e.g., from damp articles disposed within chamber 28). This internal air flows in turn from chamber 28 through an outlet assembly positioned within cabinet 12. The outlet assembly generally defines an air exhaust passage 36 and includes a trap duct 60, air handler 32, and an exhaust conduit 62. Exhaust conduit 62 is in fluid communication with trap duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through trap duct 60 to air handler 32 (e.g., as an outlet flow portion of airflow). As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, trap duct 60 may include a filter portion 68 which includes a screen filter or other suitable device for removing lint and other particulates as internal air is drawn out of chamber 28. The internal air is drawn through filter portion 68 by air handler 32 before being passed through exhaust conduit 62. After the clothing articles have been dried (or a drying cycle is otherwise completed), the clothing articles are removed from drum 26 (e.g., by accessing chamber 28 by opening door 30). The filter portion 68 may further be removable such that a user may collect and dispose of collected lint between drying cycles.

One or more selector inputs 80, such as knobs, buttons, touchscreen interfaces, etc., may be provided on a cabinet backsplash 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet backsplash 82. Display 86 may be in communication with controller 84 and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions or data that when executed by the processing device, cause the processing device to perform operations. For certain embodiments, the instructions include a software package configured to operate appliance 10 and execute certain cycles or operating modes. For example, the instructions may include a software package configured to execute the example methods 500 and 600 described below with reference to FIGS. 5 and 6, respectively.

In some embodiments, dryer appliance 10 also includes one or more sensors that may be used to facilitate improved operation of dryer appliance. For example, dryer appliance 10 may include one or more temperature sensors which are generally operable to measure internal temperatures in dryer appliance 10 or one or more airflow sensors which are generally operable to detect the velocity of air (e.g., as an air flow rate in meters per second, or as a volumetric velocity in cubic meters per second) as it flows through the appliance 10. In some embodiments, controller 84 is configured to vary operation of heating assembly 50 based on one or more temperatures detected by the temperature sensors or air flow measurements from the airflow sensors.

Figure 3:
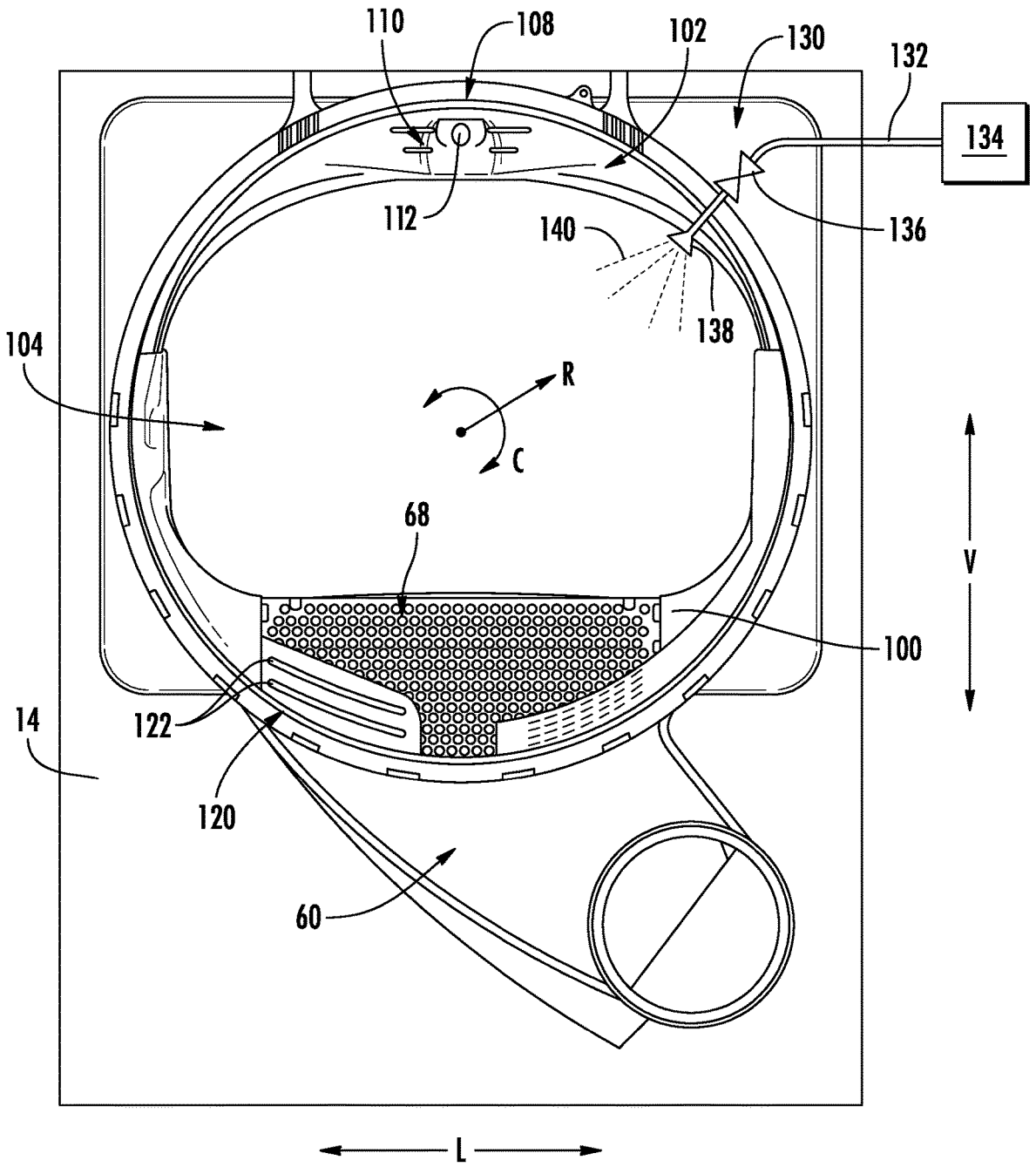
FIG. 3 provides a partial, perspective view of a drying chamber of the exemplary dryer appliance of FIG. 1.

Referring now generally to FIG. 3, dryer appliance 10 may include a front bulkhead 100 and a top bearing 102 mounted to front panel 14. Specifically, for example, front bulkhead 100 may be mounted directly to a backside of front panel 14 and may define an opening 104 through which chamber 28 may be accessed. Front bulkhead 100 may generally define a front end of chamber 28. In addition, front bulkhead 100 may house or support various components of dryer appliance, such as trap duct 60, filter portion 68, sensors, or other dryer components.

Top bearing 102 may be mounted directly to front bulkhead 100 and may be generally configured for supporting drum 26 as it rotates and housing various other dryer components. In this regard, top bearing 102 is generally positioned at a front of drum 26 and cabinet 12 (e.g., proximate a front lip 106—see FIG. 2) of drum 26. Top bearing 102 defines an outer surface 108 on which drum 26 may rotate. As best shown in FIG. 3, top bearing 102 may define a bulb housing 110 for receiving a light bulb 112 for illuminating chamber 28 when desired. The electronics (not shown) for powering light bulb 112 may be housed behind the top bearing 102 (e.g., within a cavity and may be operably coupled with controller 84 which may regulate operation of light bulb 112). According to exemplary embodiments, top bearing 102 may also house other sensors, such as temperature or humidity sensors, or other dryer components.

For example, referring still to FIG. 3, dryer appliance may include a moisture sensor 120 that is generally configured for detecting or monitoring a moisture content or dampness of a load of clothes within chamber 28 during operation of dryer appliance 10. According to the illustrated embodiment, moisture sensor 120 comprises two sensor rods 122 that are spaced apart from each other on front bulkhead 100 such that clothes within chamber 28 tumble across the sensor rods 122 during the drying process. In this manner, clothing within chamber 28 may bridge the first and second sensor rods 122 in order to close a circuit coupled to first and second sensor rods 122. Sensor rods 122 may measure a moisture content of the clothing with moisture sensor 120 (e.g., by monitoring voltages associated with dampness or moisture content within the clothing). In addition, or alternatively, moisture sensor 120 may measure the resistance between sensor rods 122 or the conduction of electric current through the clothes contacting sensor rods 122.

According to the illustrated embodiment, moisture sensor 120 includes two sensor rods 122 mounted on front bulkhead 100. However, it should be appreciated that according to alternative embodiments, moisture sensor 120 may be any other suitable type of sensor positioned at any other suitable location and having any other suitable configuration for detecting moisture content within a load of clothes. Moisture sensor 120 may generally be in communication with controller 84 and may transmit readings to controller 84 as required or desired. As explained in more detail below, dryer appliance 10 can monitor chamber humidity or the remaining moisture content of the clothes to determine when a drying cycle should end.

According to exemplary embodiments, and as best illustrated schematically in FIG. 3, dryer appliance may further include an additive supply 130 for selectively providing a dryer additive into chamber 28 (e.g., to treat articles within a dryer load). Such dryer additives may include a wrinkle release additive (e.g., a sheet, ball, or fluid comprising fabric relaxer, fabric softener, isopropyl alcohol, vinegar, etc.) to reduce or prevent wrinkles from forming on articles within a load; a UV fabric protector (e.g., a fluid comprising titanium oxide, bemotrizinol, etc.) to absorb or repel ultraviolet light emissions; a medicinal liquid (e.g., antibacterial liquid, antiallergen, dermatitis-treatment liquid, burn-treatment liquid, insect repellant, topical cannabinoid, etc.); or perfume material to provide a desirable smell or scent to a load. Moreover, it is noted that any other suitable laundry additive may be included.

In some embodiments, as illustrated, additive supply 130 includes a supply conduit 132 fluidly coupled to an additive reservoir or source 134 (e.g., within cabinet 12 or outside thereof). A supply valve 136 may be operably coupled to supply conduit 132 for regulating the flow or movement of additive therethrough. In optional embodiments, additive supply 130 includes a nozzle 138, such as a misting nozzle, that is fluid coupled to the supply conduit 132 and is positioned for discharging the flow of additive into chamber 28. Specifically, according to an exemplary embodiment, nozzle 138 is configured for receiving the flow of a liquid additive and generating a fine mist (indicated by reference numeral 140 in FIG. 3) that is dispersed throughout chamber 28. It should be appreciated that according to alternative embodiments, dryer appliance 10 may include any other suitable number, type, position, and configuration of water supply nozzles, conduits, motors, paddles, dispensers, or subsystems. For instance, a paddle or sheet dispenser may be provided for selectively releasing a determined number of discrete dryer sheets to chamber 28.

Figure 4:
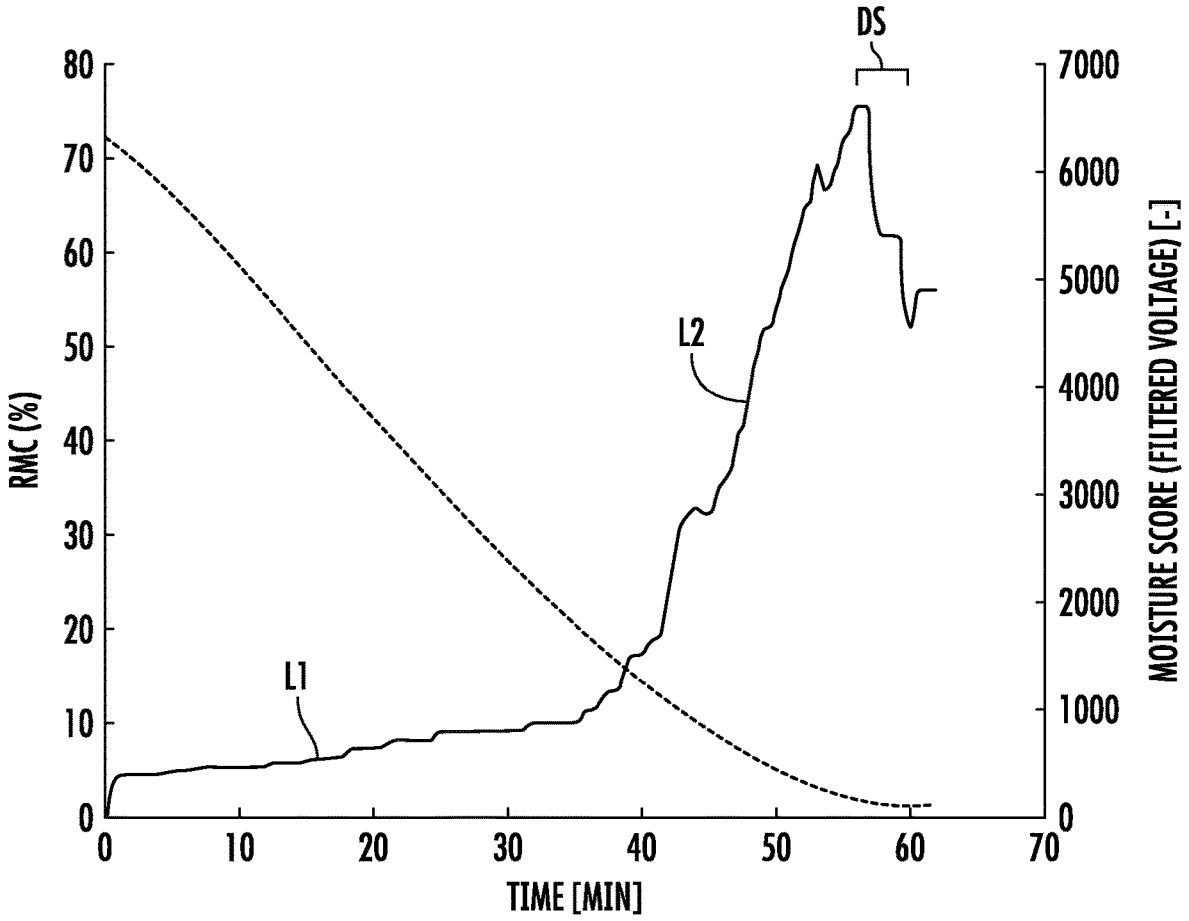
FIG. 4 provides a graph illustrating the changes to residual moisture content for dryer load and a corresponding moisture signal from a moisture sensor over time in an exemplary dryer appliance unit.

Turning now to FIG. 4, a graph illustrating an exemplary instance of a dry cycle and the observed changes to residual moisture content and a corresponding moisture signal over time. In particular, the line L1 tracks measured residual moisture content (RMS) of the articles within the drying chamber of a representative dryer unit during a dry cycle; the line L2 tracks the moisture score (e.g., filtered voltage or static level) detected at a representative moisture sensor (e.g., moisture sensor 120—FIG. 2) within the drying chamber during the dry cycle. As shown by the graph of FIG. 4, a dry cycle may steadily or continuously reduce the RMS of a particular load over the course of the dry cycle (e.g., until a threshold is reached or the cycle is otherwise halted). As a result, the RMS only drops or stays constant over time, it does not increase during the dry cycle. This steady or constant reduction may generally be reflected in the signal readings or detected moisture score, which generally increases as the RMS decreases. Nonetheless, after a significant portion of the RMS has been reduced, the detected moisture score may suddenly decrease as static interferes with voltage detection even though RMS continues to decrease. The reduction in voltage or diminished moisture signal DS may be, for instance, quantified as an observable magnitude (e.g., difference between a measured peak detected moisture score and a new moisture score on L2) or rate (e.g., slope value at L2). In other words, DS may be detected by a change in magnitude or rate of change for detected moisture score. Such a sudden reduction in voltage or diminished moisture signal DS (e.g., after a set period of cycle time) may indicate an elevated static level or static event, generally.

Figure 5:
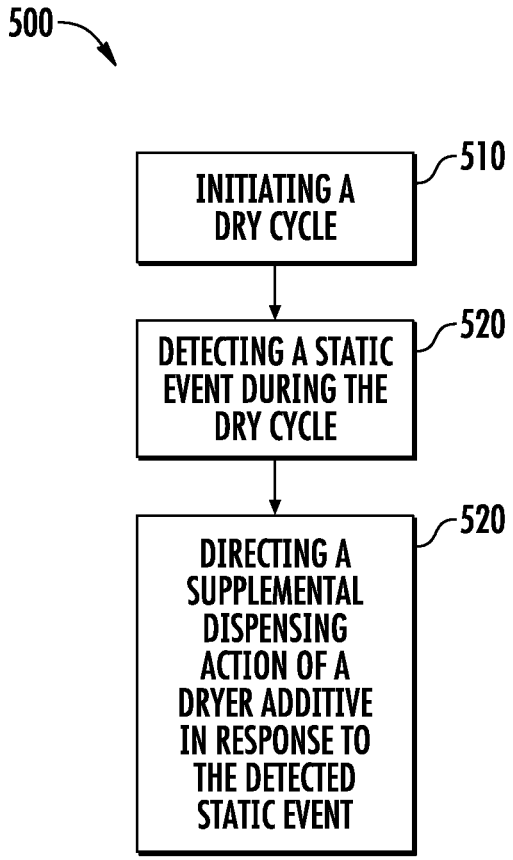
FIG. 5 provides a flow chart illustrating a method of operating a dryer appliance according to exemplary embodiments of the present disclosure.
Figure 6:
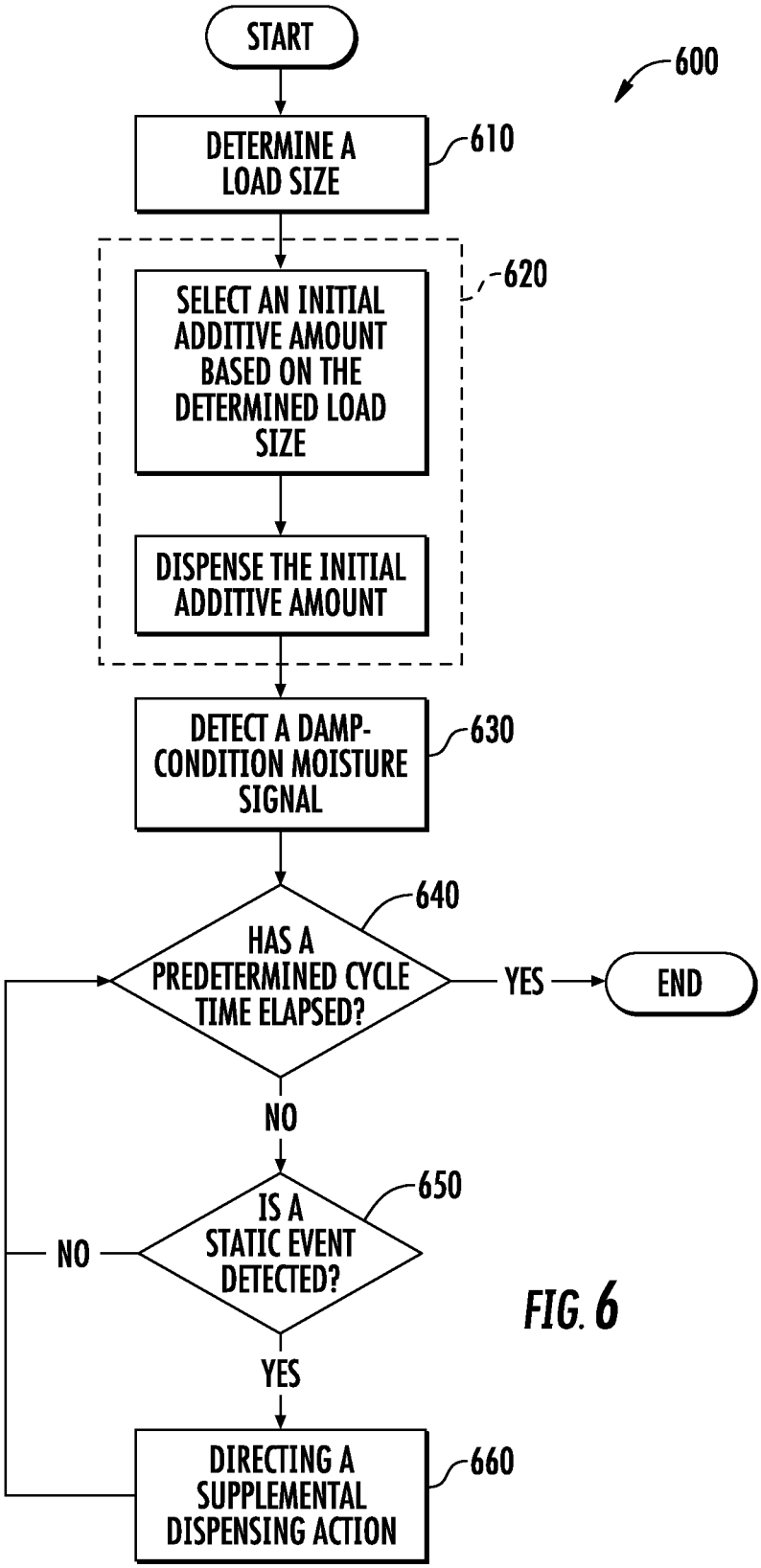
FIG. 6 provides a flow chart illustrating a method of operating a dryer appliance according to exemplary embodiments of the present disclosure.

Turning now to FIGS. 5 and 6, flow diagrams are provided of methods 500 and 600, according to exemplary embodiments of the present disclosure. Generally, the methods 500 and 600 provide methods for controlling a dryer appliance (e.g., appliance 10, as described above). Each of the methods 500 and 600 can be performed, for instance, by the controller 84. For example, controller 84 may, as discussed, be in communication with airflow sensor 90, temperature sensor 92, or heater 43. Moreover, controller 84 may send signals to and receive signals from sensor 120 or additive assembly 130. Controller 84 may further be in communication with other suitable components of the appliance 10 to facilitate operation of the appliance 10, generally. FIGS. 5 and 6 depict steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure.

Advantageously, methods in accordance with the present disclosure may dispense one or more additives affecting the smell or performance of fabrics. Additionally or alternatively, methods in accordance with the present disclosure may facilitate dispensing one or more additives at a variable amount or time (e.g., after significant drying has first occurred), thereby improving drying performance or customer satisfaction.

Turning especially to FIG. 5, at 510, the method 500 includes initiating a dry cycle. Generally, such dry cycles include motivating an airflow from the drying chamber and the air passage. For instance, 510 may include activating the blower air handler. In turn, the air handler may force air through a heating assembly, including an inlet conduit defining an air entrance passage, and into the drying chamber defined by an appliance drum. From the drying chamber, air handler may further force air through an exhaust conduit defining an air exhaust passage. Simultaneous to or separate from the motivated airflow, the heating assembly may be activated to heat the airflow or drying chamber, generally (e.g., as would be understood).

Prior to or following motivating an airflow, 510 may include determining a load size (e.g., of a load of clothes) in a chamber of the dryer appliance. For example, the controller may implement a load detection process at the beginning of each drying cycle of the dryer appliance. For example, a conventional load detection process may include periodically rotating the drum while adding incremental amounts of water and taking a variety of measurements, such as motor torque, load weight, etc. According to exemplary embodiments, the load size may be characterized as a large load, a small load, or any other suitable size therebetween. It should be appreciated that any suitable method of determinations of load size may be used while remaining within the scope of the present disclosure, such as a determination based on load mass, airflow velocity through the appliance, temperature changes across the appliance, user input, etc.

After the determined load size is determined, some embodiments include directing an initial dispensing action of a dryer additive (e.g., from an additive assembly, as described above). For instance, the initial dispensing action may be based on the determined load size. Thus, the additive assembly may be directed to release or motivate an initial volume or amount of dryer additive to the drying chamber. Optionally, larger loads may receive larger volumes or amount of dryer additive (e.g., in comparison to medium or small loads). The difference may be proportional, or alternatively, based on two or more fixed tiers (e.g., volumes or amounts) of dryer additive to be dispensed based on the determined load size. Additionally or alternatively, the initial dispensing action may occur prior to activating the heating assembly or within a set initial time period (e.g., less than two minutes) of the dry cycle.

At 520, the method 500 includes detecting a static event during the dry cycle. The static event may generally indicate the presence of relatively large amounts of static electricity within the drying chamber. For instance, 520 may include detecting an elevated static level (e.g., at a suitable electrical sensor) within the drying chamber. In some embodiments, 520 includes detecting a diminished moisture signal at a moisture sensor within the drying chamber (e.g., as described above).

In some embodiments, 520 is contingent upon detecting a damp condition prior to the static event (e.g., as indicated by the diminished moisture signal). The damp condition may be detected at the moisture sensor (e.g., moisture signals therefrom). Specifically, 520 may include detecting a damp-condition moisture signal at the moisture sensor within the drying chamber. Thus, the damp condition may be detected, for instance, based measuring a moisture score/voltage above a predetermined threshold or, additionally or alternatively, based on measuring a rate of moisture score/voltage increase. In turn, it may be ensured that the dry cycle may ensure further action is warranted.

In additional or alternative embodiments, 520 is contingent upon determining expiration of a predetermined time period prior to the static event. Specifically, the predetermined time period may be measured from the start of the dry cycle (or a portion thereof, such as following detection of the damp-condition moisture signal). In turn, it may be ensured that the dry cycle may continue for at least the predetermined time period prior to detecting the static event (e.g., as indicated by the diminished moisture signal).

At 530, the method 500 includes directing a supplemental dispensing action of a dryer additive (e.g., in response to 520). As described above, an assembly may be provided to selectively dispense to release a dryer additive to the drying chamber. Thus, such an additive assembly may be instructed (e.g., by the controller) to dispense or release a supplemental volume or amount of dryer additive to the drying chamber. Optionally, the supplemental volume or amount (e.g., volume of fluid or number of sheets) may be a fixed amount. In other words, 530 may include dispensing a predetermined indexed amount of the dryer additive.

Alternatively, the supplemental volume or amount may be a variable amount. For instance, variable amount of the dryer additive based on the detected static event (e.g., a measured level of static within the drying chamber) or size of the load. In some such embodiments, larger loads may receive larger volumes or amount of dryer additive (e.g., in comparison to medium or small loads). The difference may be proportional, or alternatively, based on two or more fixed tiers (e.g., volumes or amounts) of dryer additive to be dispensed based on the determined load size.

As would be understood, steps 520 and 530 may be repeated during the dry cycle and, thus, additional or subsequent detections of a static event may prompt additional supplemental dispensing actions.

Turning now to FIG. 6, at 610, the method 600 includes determining a load size (e.g., prior to, following, or in tandem with the start of a dry cycle). For example, the controller may implement a load detection process at the beginning of each drying cycle of the dryer appliance. For example, a conventional load detection process may include periodically rotating the drum while adding incremental amounts of water and taking a variety of measurements, such as motor torque, load weight, etc. According to exemplary embodiments, the load size may be characterized as a large load, a small load, or any other suitable size therebetween. It should be appreciated that any suitable method of determinations of load size may be used while remaining within the scope of the present disclosure, such as a determination based on load mass, airflow velocity through the appliance, temperature changes across the appliance, user input, etc.

At 620, following 610, the method 600 includes directing an initial dispensing action of a dryer additive (e.g., from an additive assembly, as described above). Specifically, an initial additive amount may be selected based on the determined load size. Moreover, the initial additive amount may be dispensed to the drying chamber. Thus, the additive assembly may be directed to release or motivate an initial volume or amount of dryer additive to the drying chamber. Generally, larger loads may receive larger volumes or amount of dryer additive (e.g., in comparison to medium or small loads). The difference may be proportional, or alternatively, based on two or more fixed tiers (e.g., volumes or amounts) of dryer additive to be dispensed based on the determined load size. Additionally or alternatively, the initial dispensing action may occur prior to activating the heating assembly or within a set initial time period (e.g., less than two minutes) of the dry cycle.

At 630, the method 600 includes detecting a damp moisture signal. Specifically, 630 may include detecting a damp-condition moisture signal at the moisture sensor within the drying chamber. Thus, the damp condition may be detected, for instance, based measuring a moisture score/voltage above a predetermined threshold or, additionally or alternatively, based on measuring a rate of moisture score/voltage increase. Following 630, the method 600 may proceed to 640.

At 640, the method 600 includes evaluating the time progress of the dry cycle. Specifically, it is determined if a predetermined cycle time (e.g., maximum span of time for the dry cycle) has expired. Measurement of the predetermined cycle time may begin in tandem with the start of the dry cycle. Thus, the time for which the corresponding dry cycle has continued may be measured. If the predetermined cycle time has expired, the dry cycle may reach its natural end. By contrast, if the predetermined cycle time has not expired, the method 600 may proceed to 650.

At 650, the method 600 includes evaluating for a static event. The static event may generally indicate the presence of relatively large amounts of static electricity within the drying chamber. For instance, 650 may detect a static event based on an elevated static level (e.g., at a suitable electrical sensor) within the drying chamber. Moreover, 650 may detect a static event based on a diminished moisture signal at a moisture sensor within the drying chamber (e.g., as described above). If the static even is not detected, the method 600 may return to 640. By contrast, if the static event is detected, the method 600 may proceed to 660.

At 660, the method 600 includes directing a supplemental dispensing action of a dryer additive in response to 650. Specifically, the additive assembly may be instructed (e.g., by the controller) to dispense or release a supplemental volume or amount of dryer additive to the drying chamber. Optionally, the supplemental volume or amount may be a fixed amount. In other words, 660 may include dispensing a predetermined indexed amount of the dryer additive.

Alternatively, the supplemental volume or amount may be a variable amount. For instance, variable amount of the dryer additive based on the detected static event (e.g., a measured level of static within the drying chamber) or size of the load. In some such embodiments, larger loads may receive larger volumes or amount of dryer additive (e.g., in comparison to medium or small loads). The difference may be proportional, or alternatively, based on two or more fixed tiers (e.g., volumes or amounts) of dryer additive to be dispensed based on the determined load size.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a drying chamber for the receipt of clothes for drying;

an additive dispensing assembly positioned within the cabinet and configured to selectively provide an additive to the drying chamber;

a moisture sensor mounted within the dryer appliance in communication with the drying chamber; and a controller in operable communication with the additive dispensing assembly and the moisture sensor, the controller being configured to initiate a drying operation comprising initiating a dry cycle, detecting a static event during the dry cycle, determining the static event comprising determining expiration of a predetermined time period and detecting a diminished moisture signal at the moisture sensor following expiration of the predetermined time period, and directing a supplemental dispensing action of a dryer additive in response to the detected static event.

2. The dryer appliance of claim 1, wherein initiating the dry cycle further comprises determining, prior to detecting the static event, a load size, and directing an initial dispensing action of a dryer additive based on the determined load size.

3. The dryer appliance of claim 2, wherein directing the initial dispensing action comprises directing a variable amount of the dryer additive to the drying chamber corresponding to the determined load size.

4. The dryer appliance of claim 1, wherein detecting the static event during the dry cycle comprises detecting an elevated static level within the drying chamber.

5. The dryer appliance of claim 1, wherein detecting the static event during the dry cycle comprises detecting, prior to detecting the diminished moisture signal, a damp-condition moisture signal at the moisture sensor within the drying chamber.

6. The dryer appliance of claim 1, wherein the supplemental dispensing action comprises a dispensing a predetermined indexed amount of the dryer additive.

7. The dryer appliance of claim 1, wherein the supplemental dispensing action comprises a dispensing a variable amount of the dryer additive.

8. A dryer appliance comprising:

a cabinet;

a drum rotatably mounted within the cabinet, the drum defining a drying chamber for the receipt of clothes for drying;

an additive supply mounted to the cabinet to selectively provide an additive to the drying chamber, the additive supply comprising an additive reservoir and a nozzle downstream from the additive reservoir and directed to the drying chamber for discharging the additive therein; and a moisture sensor mounted within the dryer appliance in communication with the drying chamber; and a controller in operable communication with the additive dispensing assembly and the moisture sensor, the controller being configured to initiate a drying operation comprising initiating a dry cycle, detecting a static event during the dry cycle, determining the static event comprising determining expiration of a predetermined time period and detecting a diminished moisture signal at the moisture sensor following expiration of the predetermined time period, and directing a supplemental dispensing action of a dryer additive in response to the detected static event.

9. The dryer appliance of claim 8, wherein initiating the dry cycle further comprises determining, prior to detecting the static event, a load size, and directing an initial dispensing action of a dryer additive based on the determined load size.

10. The dryer appliance of claim 9, wherein directing the initial dispensing action comprises directing a variable amount of the dryer additive to the drying chamber corresponding to the determined load size.

11. The dryer appliance of claim 8, wherein detecting the static event during the dry cycle comprises detecting an elevated static level within the drying chamber.

12. The dryer appliance of claim 8, wherein detecting the static event during the dry cycle comprises detecting, prior to detecting the diminished moisture signal, a damp-condition moisture signal at the moisture sensor within the drying chamber.

13. The dryer appliance of claim 8, wherein the supplemental dispensing action comprises a dispensing a predetermined indexed amount of the dryer additive.

14. The dryer appliance of claim 8, wherein the supplemental dispensing action comprises a dispensing a variable amount of the dryer additive.

15. A dryer appliance comprising:

a cabinet;

a drum rotatably mounted within the cabinet, the drum defining a drying chamber for the receipt of clothes for drying;

an additive supply mounted to the cabinet to selectively provide an additive to the drying chamber, the additive supply comprising an additive reservoir and a nozzle downstream from the additive reservoir and directed to the drying chamber for discharging the additive therein; and a moisture sensor mounted within the dryer appliance in communication with the drying chamber; and a controller in operable communication with the additive dispensing assembly and the moisture sensor, the controller being configured to initiate a drying operation comprising initiating a dry cycle, detecting a static event during the dry cycle, determining the static event comprising determining expiration of a predetermined time period and detecting an elevated static level within the drying chamber following expiration of the predetermined time period, and directing a supplemental dispensing action of a dryer additive in response to the detected static event.

16. The dryer appliance of claim 15, wherein initiating the dry cycle further comprises determining, prior to detecting the static event, a load size, and directing an initial dispensing action of a dryer additive based on the determined load size.

17. The dryer appliance of claim 16, wherein directing the initial dispensing action comprises directing a variable amount of the dryer additive to the drying chamber corresponding to the determined load size.

18. The dryer appliance of claim 15, wherein detecting the static event during the dry cycle comprises detecting, prior to detecting an elevated static level within the drying chamber, a damp-condition moisture signal at the moisture sensor within the drying chamber.

* * * * *